US011253072B2

(12) United States Patent
Franco

(10) Patent No.: US 11,253,072 B2
(45) Date of Patent: Feb. 22, 2022

(54) MODULAR REUSABLE WRITING PANELS AND SYSTEM THEREOF

(71) Applicant: COMSERO, INC., Denver, CO (US)

(72) Inventor: Anthony Franco, Broomfield, CO (US)

(73) Assignee: COMSERO, INC., Denver, CO (US)

( * ) Notice: Subject to any disclaimer, the term of this patent is extended or adjusted under 35 U.S.C. 154(b) by 0 days.

(21) Appl. No.: 16/908,177

(22) Filed: Jun. 22, 2020

(65) Prior Publication Data

US 2020/0315351 A1 Oct. 8, 2020

Related U.S. Application Data

(63) Continuation of application No. 16/588,144, filed on Sep. 30, 2019, now Pat. No. 10,702,065, which is a continuation-in-part of application No. 16/137,487, filed on Sep. 21, 2018, now Pat. No. 10,427,450.

(60) Provisional application No. 62/561,568, filed on Sep. 21, 2017, provisional application No. 62/561,570, filed on Sep. 21, 2017, provisional application No. 62/561,550, filed on Sep. 21, 2017.

(51) Int. Cl.

| | |
|---|---|
| ***A47B 97/00*** | (2006.01) |
| ***B43L 1/00*** | (2006.01) |
| *B43L 1/04* | (2006.01) |

(52) U.S. Cl.

CPC ..... *A47B 97/001* (2013.01); *B43L 1/008* (2013.01); *B43L 1/045* (2013.01)

(58) Field of Classification Search

CPC ..... B43L 1/04; B43L 1/045; G09F 7/04

See application file for complete search history.

(56) References Cited

U.S. PATENT DOCUMENTS

| | | | | |
|---|---|---|---|---|
| 3,110,917 | A | 11/1963 | Mcpeek | |
| 4,100,684 | A | 7/1978 | Berger | |
| 4,207,646 | A | 6/1980 | Osborne | |
| 4,415,092 | A | 11/1983 | Boyer | |
| 4,875,591 | A | 10/1989 | Mikesell | |
| 5,072,483 | A | 12/1991 | Durand | |
| 5,269,083 | A * | 12/1993 | Vampatella | A47G 1/065 248/206.5 |
| 5,432,973 | A | 7/1995 | Wagner et al. | |
| 5,775,919 | A | 7/1998 | Gardner | |
| 5,836,038 | A | 11/1998 | Thorp | |
| 5,947,304 | A | 9/1999 | Thorp | |
| 6,007,891 | A | 12/1999 | Davis et al. | |
| 6,056,468 | A | 5/2000 | Niewiadomski | |
| 6,186,461 | B1 | 2/2001 | Pelaez | |
| 6,431,513 | B1 | 8/2002 | Rosen | |
| 6,484,428 | B1 | 11/2002 | Greenwald et al. | |
| 6,793,430 | B1 | 9/2004 | Liu | |
| 7,128,798 | B2 | 10/2006 | Boudouris et al. | |
| 7,309,181 | B2 | 12/2007 | Hawkins | |
| 7,338,573 | B2 | 3/2008 | Boudouris et al. | |

(Continued)

*Primary Examiner* — Gary C Hoge
(74) *Attorney, Agent, or Firm* — Dorsey & Whitney LLP

(57) ABSTRACT

In one embodiment, a reusable writing kit is disclosed. The kit includes a substrate comprising a substrate writable surface and a substrate rear surface and a panel releasably mountable to the substrate. The panel includes a panel writing surface, a panel rear surface, and a first attachment member having a first type of securing force operable to mount the panel to the substrate, where the panel is mounted to the substrate and the panel rear surface is spaced apart from the substrate writable surface.

16 Claims, 6 Drawing Sheets

(56) References Cited

U.S. PATENT DOCUMENTS 7,967,520 B2 6/2011 Hawkins
8,032,966 B1 10/2011 Keller
D663,776 S 7/2012 Lira-nunez et al.
D669,937 S 10/2012 Lira-nunez et al.
9,409,437 B2 8/2016 Green et al.
2005/0044767 A1 3/2005 Lasher
2006/0222858 A1 10/2006 Haas
2006/0248765 A1* 11/2006 Bodinet ..... G09F 7/04 40/600
2007/0017135 A1* 1/2007 Sharp-Mommeut .... G09F 21/02 40/618
2007/0044360 A1* 3/2007 Hillis ..... G09F 7/04 40/621
2007/0056199 A1* 3/2007 Pelkowski ..... G09F 7/04 40/600
2007/0141546 A1* 6/2007 Kang ..... B32B 15/046 434/408
2008/0120922 A1 5/2008 Sullivan et al.
2008/0166173 A1 7/2008 Gibbons
2009/0108968 A1* 4/2009 Tsai ..... G09F 7/04 335/219
2009/0193629 A1* 8/2009 Suenaga ..... G09F 7/04 24/303
2009/0250575 A1* 10/2009 Fullerton ..... G09F 7/04 248/206.5
2010/0024266 A1* 2/2010 Pemberton ..... G09F 13/08 40/600
2010/0068422 A1* 3/2010 Keyes ..... G09F 7/04 428/13
2010/0293821 A1 11/2010 Sullivan et al.
2011/0146126 A1 6/2011 Phillips
2013/0074299 A1 3/2013 Rojdev
2014/0239142 A1* 8/2014 Frenzel ..... G06F 1/1613 248/451
2014/0377736 A1* 12/2014 Essen ..... B43L 1/008 434/408
2015/0034799 A1* 2/2015 Krapf ..... B43L 3/008 248/683
2016/0073796 A1* 3/2016 Nesbitt ..... A47G 1/065 40/711
2016/0081476 A1 3/2016 Meverden
2016/0271998 A1* 9/2016 Shen ..... B43L 1/00
2016/0309927 A1* 10/2016 Krake ..... G09F 7/18
2017/0303373 A1 10/2017 Vicknair
2018/0226002 A1* 8/2018 Sandow ..... G09F 7/04
2019/0333423 A1* 10/2019 Kehoe ..... G09F 7/04

* cited by examiner

MODULAR REUSABLE WRITING PANELS AND SYSTEM THEREOF

CROSS REFERENCE TO RELATED APPLICATIONS

This application is a continuation of U.S. patent application Ser. No. 16/588,144, filed on Sep. 30, 2019, titled "Modular Reusable Writing Panels and System Thereof," which is a continuation-in-part of U.S. patent application Ser. No. 16/138,487, filed on Sep. 21, 2018, titled "Modularly Stackable Dry Erase Panels and System Thereof," now U.S. Pat. No. 10,427,450, issued on Oct. 1, 2019, which claims priority to U.S. Provisional Patent Application 62/561,550 filed on Sep. 21, 2017 and entitled "Reconfigurable Apparatus and System for Marking and Displaying of Items," U.S. Provisional Patent Application 62/561,570 filed on Sep. 21, 2017 and entitled "Dry Erase Board Eraser,", and U.S. Provisional Patent Application 62/561,568 filed on Sep. 21, 2017, entitled "Modularly Stackable Dry Erase Panels and System Thereof" all of which are hereby incorporated by reference in their entirety.

FIELD

The present invention relates to a stackable and modularly reconfigurable device and system providing a surface for marking and displaying items. More specifically, the present invention relates to a modularly reconfigurable device and system having erasable writing surfaces with interconnection features.

BACKGROUND

Dry erase boards provide a surface for erasable writing surface to leave little or no visible residue when erased. Dry erase boards have become a widely accepted tool of written and graphic communication, or written content, for entities such as corporations, teaching institutions, and creative groups. Technologies enabling the erasable writing surface of dry erase boards are known to persons of ordinary skill in the art. A dry erase board typically includes a board or substrate having a surface treated with an enamel, film, ultraviolet cured liquid, liquid varnish, or porcelain finish. The substrate is affixed to a structure allowing individuals to write on it with specially designed markers. While the ink of the marker dries on the substrate, the ink does not bond to the substrate surface and the writing can be easily removed with a soft eraser, cloth, finger, etc.

The rapid drying nature of the ink of the specially designed markers provides users with a rapidly editable product which has become widely accepted for collaborative and brain storming sessions as well as other scenarios which may benefit from such characteristics.

Some collaborative and brain storming activities, sometimes referred to as ideation, still use separate technologies enabling such activities. An activity surrounding collaborative thinking, brain storming or ideation commonly use adhesive-backed notes, such as Post-It® notes. Adhesive-backed notes are small pieces of paper with an adhesive strip allowing a user to document a thought, list or other noteworthy information and temporarily adhere it to a surface. In brainstorming, adhesive-backed notes allow communication of by way of displaying content on a communal board. In some circumstances, a first note having similar content to a second note, may be removed and co-located with the second note. Sometimes it may be preferred to place the first note beside the second note, in other situations it may be preferred to place the first note such that it overlaps or completely conceals the second note.

The use of adhesive-backed notes and the like for brainstorming, albeit effective, creates unnecessary waste. Therefore, there is an identified need for erasable writing surfaces configured to have functionality similar to that of adhesive-backed notes and the like.

SUMMARY

It is an aspect of the present disclosure to provide erasable or otherwise reusable writing surfaces that allow a user to use erasable writing surfaces, such as dry or wet erase boards in a various manner, including those similar to the use of adhesive-backed notes, but in a reusable manner.

The following references related to wall hanging an object are hereby incorporated by reference in their entireties: U.S. Pat. No. 7,128,798 to Boudouris, et al. ("the '798 reference"), surrounding magnetic substrates, composition and methods for making the same; U.S. Pat. No. 7,338,573 to Boudouris ("the '573 reference"), surrounding magnetic substrates with high magnetic loading; and U.S. Patent Application Publication No. 2006/0222858 to Haas ("Haas"), surrounding flexible dry-erase and instructional magnets. Each of the above referenced patent publications surround the application of sheet magnets to a first surface of a substrate. Haas particularly points out the application of a dry erase layer to a magnetic substrate resulting a dry erase layer which can be removably affixed to a magnetically attractable surface. Haas further discloses his dry erase magnet to result in a stack-able magnet surface for dry erase marking, However, the stacking of a first dry erase magnet on top of a second dry erase magnet of Haas, would likely result in the disfiguring of content. This disfiguring occurs when placing the first dry erase magnet atop the second dry erase magnet, or when removing the first dry erase magnet from the second dry erase magnet, It is a further aspect of the present invention to provide a first erasable writing surface which can be removably affixed to a second erasable writing surface without disfiguring the content displayed on the second erasable writing surface.

Certain embodiments of the present invention comprise a magnet affixed to a rear surface of a panel such that the magnet protrudes from the rear surface of the panel. In certain embodiments, a first magnet is embedded within the thickness of a panel with a first end of the magnet protruding from the rear surface of the panel. The protrusion of a first end of a magnet from the rear surface of the panel allows the panel to be affixed to a magnetically attractable surface without disfiguring content on the magnetically attractable surface. In certain embodiments, a second end of a magnet is embedded within the thickness of the panel, proximally located to a front surface of the panel. A magnetically attractable material of various embodiments include, but are not limited to, ferromagnetic materials including iron, nickel, cobalt and some alloys of rare-earth metals.

Certain embodiments comprise a magnet embedded into a panel. In such embodiments, the panel lacks a recess. The present inventor recognizes the advantage of such embodiment that such a panel is stackable on other panels without the need for alignment of a protrusion of one panel to a recess of another panel. In an embodiment, the polarity of the magnets of one panel relative to the magnets of another panel are configured such that the panels will not stack in any direction other than the orientation caused by the forces generated by the magnets in each panel. In an embodiment of the invention, the magnets cause the panels to orient in the same direction as the orientation. of a tablet as disclosed in U.S. Provisional Patent Application 62/561,550 filed on Sep. 21, 2017, which is incorporated by reference in its entirety.

Various embodiments surround a system having a first panel and a second panel. The first panel has an affixed first magnet such that a north pole of the first magnet protrudes from the rear surface of the first panel. A south pole of the first magnet is embedded within the thickness of the first panel proximal to the front surface of the first panel. The second panel has an affixed first magnet such that a north pole of the first magnet protrudes from the rear surface of the second panel. A south pole of the first magnet of the second panel is embedded within the thickness of the second panel proximal to the front surface of the second panel. Thus, the first panel may be affixed to a front surface of the second panel. Aligning the north pole of the first magnet of the first panel to the south pole of the first magnet of the second panel affixes the first panel to the second panel with increased retention. It will be appreciated by a person having ordinary skill in the art that the polarity of the magnets of the first panel and second panel may be reversed while keeping with the spirit and scope of the present invention.

In certain embodiments, a first panel has an affixed magnet, and a second panel has a magnetically attractable surface. Thus, the first panel may be affixed to the second panel by disposing a first magnet of the first panel against the magnetically attractable surface of the second panel.

Various embodiments allow for the stacked, or stagger-stacked fixation of a first panel to a second panel. It will be appreciated that a stagger-stacked configuration of elements surrounds a first element overlapping a portion of a second element, thus exposing surfaces of both the first element and the second element.

Certain embodiments surround a system having panels for mating with a magnetically attractable substrate. In certain embodiments, a magnetically attractable substrate may further comprise integrated magnets for alignment, to provide confirmation of alignment of a tablet to the surface in a predetermined array configuration. Such magnets for alignment provide increased retention of tablets and provide a predetermined array configuration having a pleasing aesthetic.

A system, in certain embodiments, comprises a magnetically attractable substrate having a dry erase surface. Alignment magnets are integrated into the substrate such that a first surface of the alignment magnet is consistent with or proximal to the dry erase surface. Thus, when a magnet of a panel is placed upon the magnetically attractable surface, it is removably affixed to the dry erase surface. A user may slidably align a magnet of a panel with an alignment magnet, thus resulting in increased fixation of the panel to the substrate at the point of the first alignment magnet.

In one embodiment, a reusable writing kit is disclosed. The kit includes a substrate comprising a substrate writable surface and a substrate rear surface and a panel releasably mountable to the substrate. The panel includes a panel writing surface, a panel rear surface, and a first attachment member having a first type of securing force operable to mount the panel to the substrate, where the panel is mounted to the substrate and the panel rear surface is spaced apart from the substrate writable surface.

In another embodiment, a reusable writing system is disclosed. The reusable writing system includes a first panel comprising an erasable surface, a second panel; and a first attachment member coupled to the first panel and positioned between the first panel and the second panel, where the first panel is spaced apart from the second panel by at least a portion of a length of the first attachment member.

In yet another embodiment, a reusable writing panel is disclosed. The writing panel includes an erasable writing surface, a back surface coupled to the erasable writing surface; and an attachment member coupled to and extending outwards from the back surface so as to protrude from the back surface, wherein the attachment member is configured to define a gap between the back surface and a mounting surface when the reusable writing panel is positioned on the mounting surface.

These and other advantages will be apparent from the disclosure contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 1B—A rear view of certain embodiments of a panel

FIG. 1C—A side cross sectional view of certain embodiments of a panel

FIG. 2B—A perspective view of certain embodiments of a system

FIG. 3B—A side cross sectional view of certain embodiments of a system

DETAILED DESCRIPTION OF VARIOUS EMBODIMENTS

In one embodiment, a reusable writing panel including a writing surface and attachment mechanisms is disclosed. The writing panel may include a stacked layer configuration, having a front or first layer defining a writing surface and a rear or second layer defining a connection surface, with an optional spacer layer positioned therebetween. The connection surface may include one or more attachable or securable elements, such as a first attraction element and a second attraction element, that may generate different types of attraction forces, e.g., magnetic and suction. This variation in connection types allows the panel to be securable to various types of objects or surfaces, e.g., magnetic and non-magnetic surfaces.

In some embodiments, the two attraction or connection members may be aligned with one another, such that attraction force is generated from the same area or location of the panel, such that a user does not need to reorient or otherwise secure the panel in a different manner depending on the attraction force that will be used to mount the panel. For example, the first attraction force may be a magnet partially or fully embedded into the panel and the second attraction force may be a suction force, such as a micro suction form, that may cover the exposed surface of the magnet. In this manner, the second attraction member may also assist in securing the first attraction member to the panel and the magnetic force extends through foam, allowing the panel to be connected via the magnetic force and/or via the suction force. In some instances, the two forces may combine to generate a combined force, further assisting the panel in being secured to the desired surface or object. Further, the attachment mechanisms for the panel allow the panel to be attached and detached from surfaces and objects multiple times, allowing the panel to be reused and have an extended life over other types of attachable writing surfaces, e.g., adhesively attached paper.

The modular and reattachable panel can be used in combination with other writing surfaces and/or substrates, to define a writing system. For example, a substrate (that may define a writing surface) can be provided on which two or more writing panels can be secured at various positions.

As described below, embodiments of the present invention surround a panel 1000 providing a surface for erasable writing and configurations comprising mounting features, securing, attachment, interconnection features and/or other features. It is the applicant's intent that this specification and the claims appended here to be accorded a breadth in keeping with the scope and spirit of the invention being disclosed despite what might appear to be limiting language imposed by the requirements of referring to the specific examples disclosed.

Figure 1A:
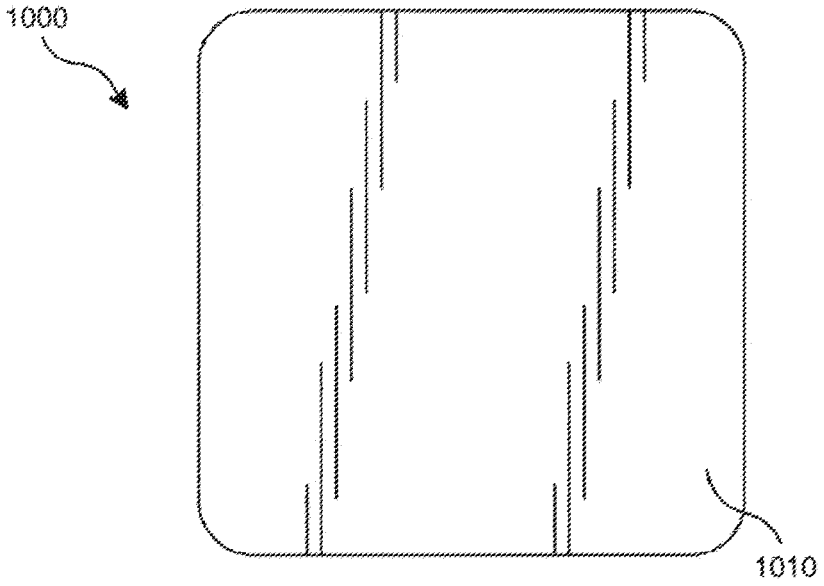
FIG. 1A—A front view of certain embodiments of a panel
Figure 1B:
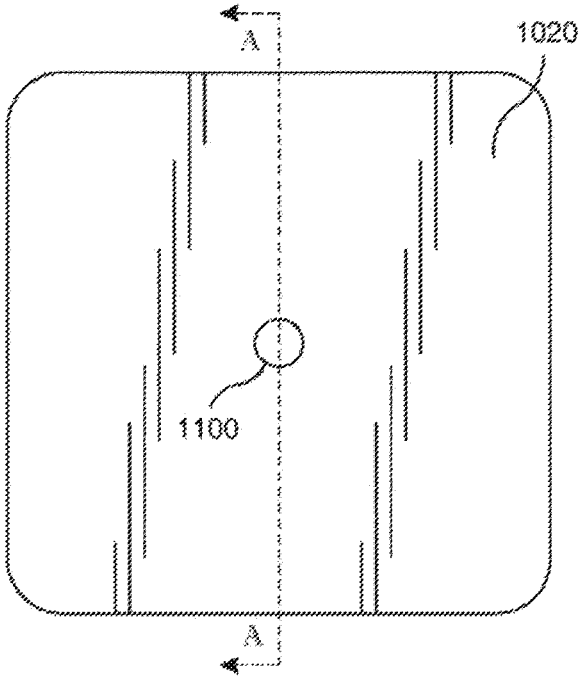
Figure 1C:
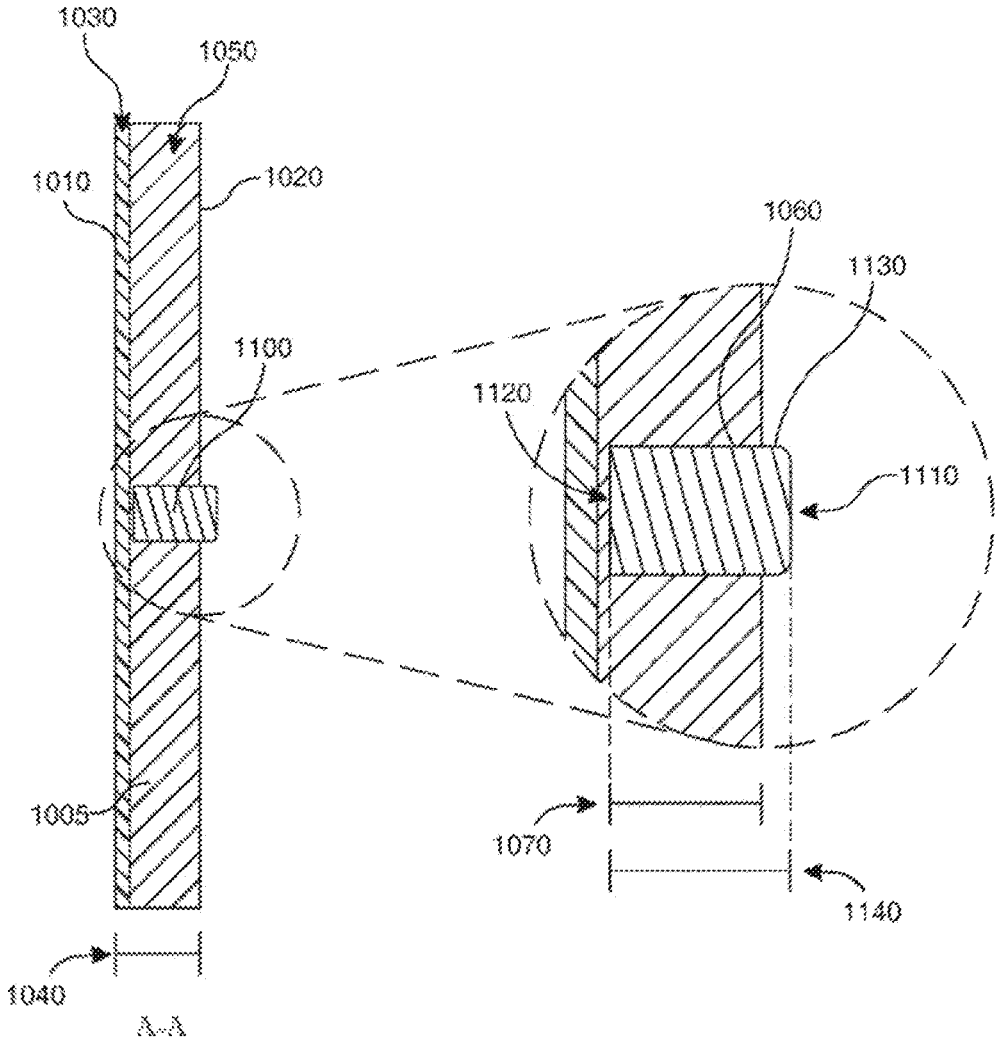

Certain embodiments of the present invention, shown in FIG. 1A and FIG. 1B, comprise a panel 1000 having a first surface 1010 and a second surface 1020. The first surface 1010 of certain embodiments comprises a surface treatment 1030 (FIG. 1C). Surface treatments 1030, as directed to the present invention include a dry or wet erase surface or a chalk board surface. However, the embodiments of the present invention are not limited to the above-mentioned surface treatments and may include other surface treatments providing an erasable or reusable writing surface and/or magnetically attractable surface. In certain embodiments, a panel 1000 comprises a substantially square shape. However, it will be appreciated that embodiments may comprise a panel 1000 having a shape other than a square while remaining in scope and spirit of the present invention. A panel 1000, in various embodiments, comprises a first magnet 1100 affixed to the second surface 1020 of the panel 1000.

In certain embodiments, shown in FIG. 1C, a panel 1000 comprises a first surface 1010 having a surface treatment and a second surface 1020. A first magnet 1100 is affixed to the panel 1000 such that a first end 1110 of the first magnet protrudes from the second surface 1020 of the panel. In an alternative embodiment, the first magnet 1100 is embedded between the first surface 1010 and the second surface 1020.

In certain embodiments, shown in FIG. 1C, the first magnet 1100 further comprises a second end 1120 embedded into a thickness 1040 of a panel such that a second end 1120 of the first magnet is proximal to the first surface 1010 of the panel. In various embodiments, a magnet 1100 is embedded into the thickness 1040 of the first panel using a recess 1060 consistent with the second surface 1020 of the panel. The recess 1060 or aperture comprises a profile configured to receive the magnet. In certain embodiments, the recess 1060 is configured to mate with an outer surface 1130 of the magnet resulting in an engineering fat, An engineering fit will be appreciated to surround a location fit, press fit, interference fit, RC fit, or other engineering fit such as those specified by ANSI B41 (Standard Tolerance Limits and Fits), incorporated by reference herein. It will be further appreciated that other engineering fits or assembly strategies known to those skilled in the art may be used while in keeping with the scope and spirit of the present invention. It will be further appreciated that a magnet 1100 may be affixed to a panel using means in the prior art, such as by adhesive fixation or overmolding. In an alternative embodiment, a magnet 1100 may be affixed to the interior of the first surface 1010 and/or the second surface 1020 such that the magnet 1100 is embedded between the first surface 1010 and the second surface 1020.

In certain embodiments, shown in FIG. 1C, a panel 1000 has a recess 1060 with a magnet 1100 disposed within the recess 1000. The recess 1060 has a depth 1070 less than the thickness 1040 of the panel, and the magnet 1100 has a length 1140 greater than the depth 1070 of the recess 1060. The recess 1060 is configured to receive the magnet 1100, allowing the fixation of the magnet 1100 within the recess 1060. A first end 1110 of the magnet protrudes from the second surface 1020 of the panel and a second end 1120 of the magnet is disposed within the recess. In certain embodiments, a recess 1060 may have a depth 1070 equal to the thickness 1040 of the panel.

Figure 2A:
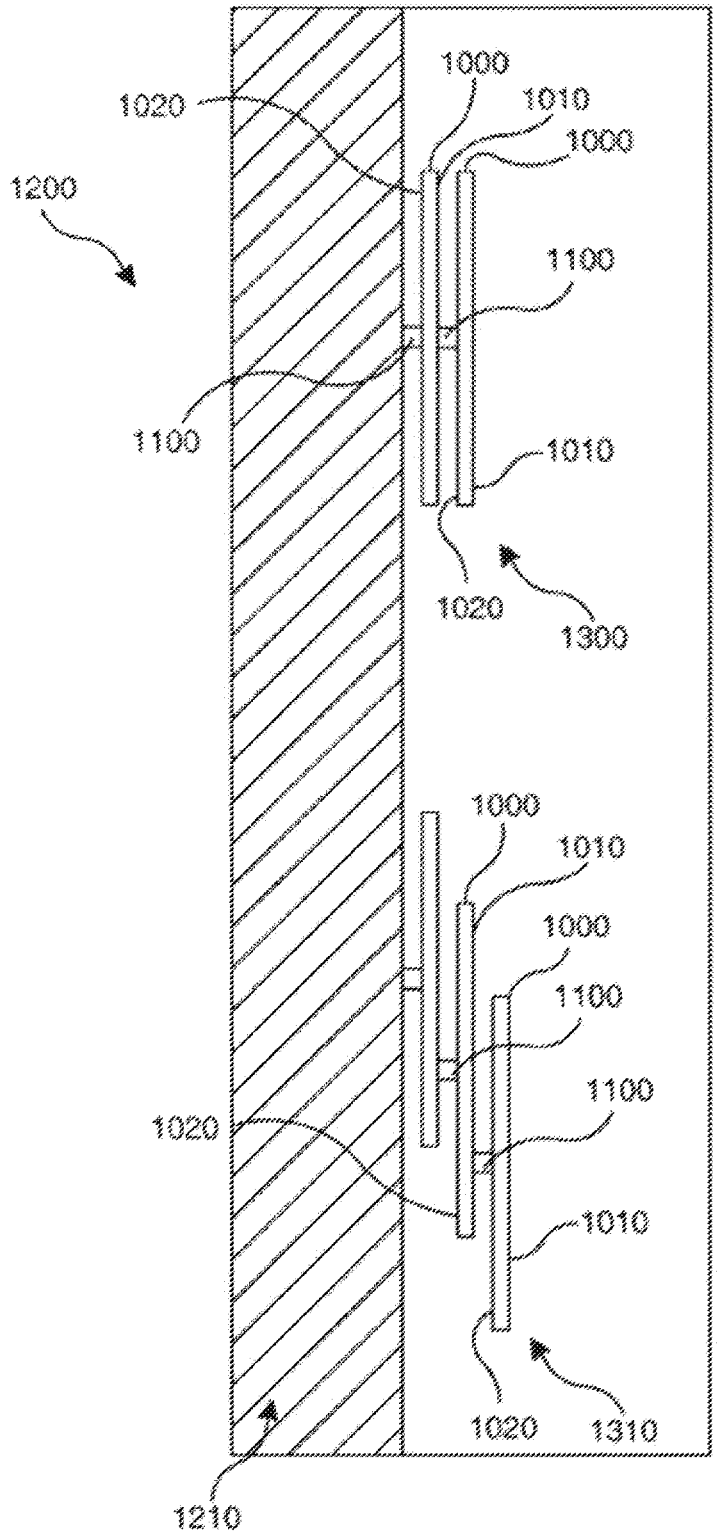
FIG. 2A—A side view of certain embodiments of a system
Figure 2B:
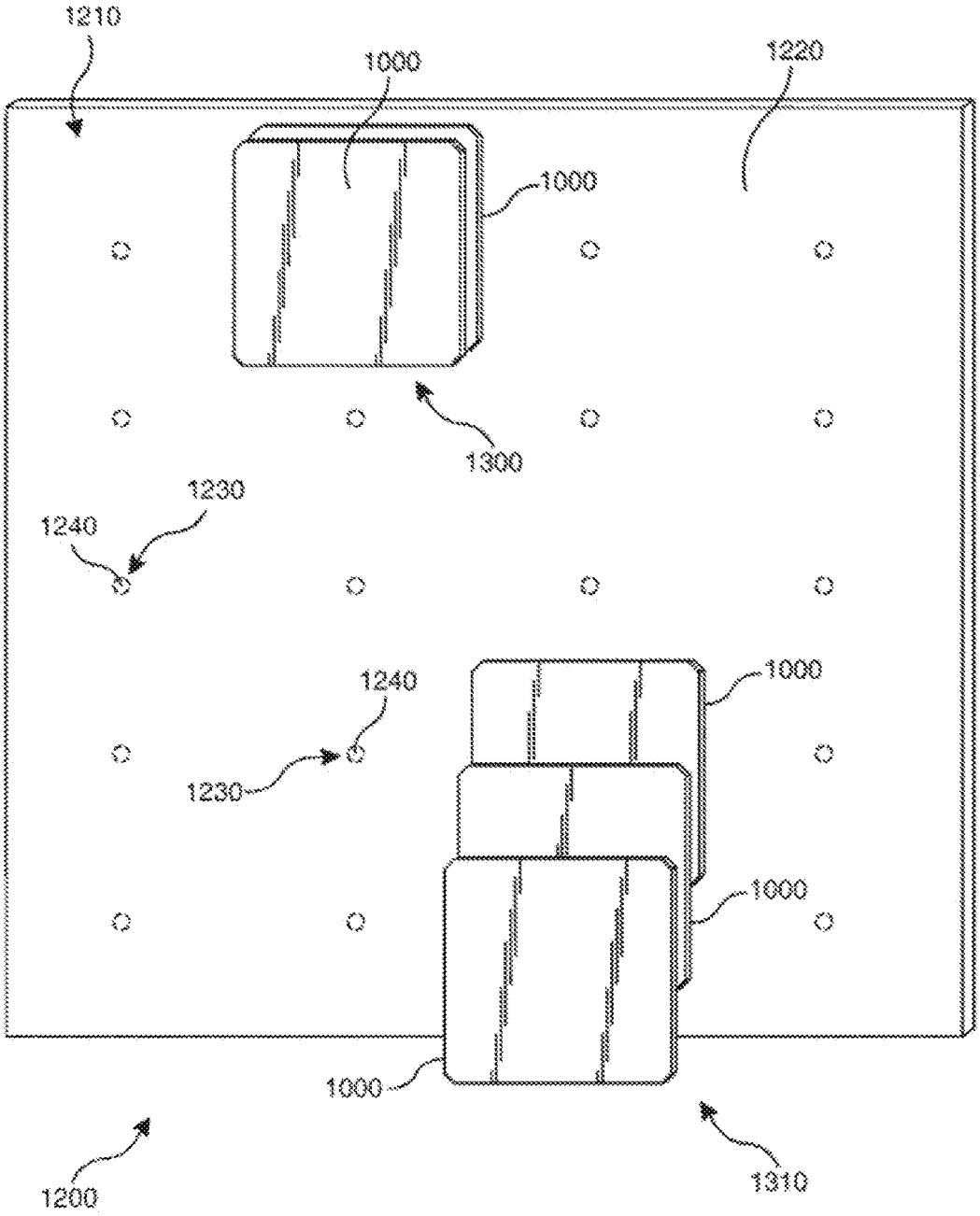

Certain embodiments of the present invention, shown in FIG. 2.A, are directed to a system 1200 comprising a first panel 1000, as shown in FIG. 1C, having a first surface 1010, a second surface 1020 and a first magnet 1100. The system 1200, referencing FIG. 2A, further comprises a second panel 1000 having a first surface 1010 and a second surface 1020. The first surface 1010 of the second panel comprises a magnetically attractable material such that disposing the first magnet 1100 of the first panel to the first surface 1010 of the second panel results in the fixation of the first panel 1000 to the second panel 1000. It will be appreciated that a first panel 1000 and a second panel 1000 of the present embodiment may be connected in a stacked configuration 1300 or stagger-stacked configuration 1310 as shown in FIG. 2A and FIG. 2B.

Certain embodiments of a system 1200, shown in FIG. 2B, comprise a substrate 1210 having a magnetically attractable first surface 1220. In certain embodiments, a substrate 1210 comprises a first alignment magnet 1230. In certain embodiments, shown in FIG. 2B, a substrate 1210 comprises a plurality of alignment magnets 1230. A first alignment magnet 1230 is combined with the substrate 1210 such that a first end 1240 of the first alignment magnet 1230 is consistent with or recessed from the first surface 1220 of the first substrate, thus providing an uninterrupted first surface 1220 of the substrate. An uninterrupted first surface 1220 of the substrate allows the unfettered slidable rearrangement of a panel 1000 on the first surface 1220. The connection of a first magnet of a first panel 1000 to a. first surface 1220 results in the retention of the first panel 1000 to the substrate 1210. The alignment of a first magnet of a first panel 1000 with a first alignment magnet 1230 provides for increased retention of the first panel to the substrate 1210.

It will be appreciated that in embodiments, referencing FIG. 1C and FIG. 2B which the first end 1110 of a first magnet protrudes from a first panel 1000 for fixation to a magnetically attractable surface 1220, the first end 1110 of the magnet comprises a north pole. A first end 1240 of an alignment magnet consistent with a first surface 1220 of a substrate comprises a south pole. Alternatively, embodiments in which the first end 1110 of a first magnet comprises a south pole, a first end 1240 of an alignment magnet comprises a north pole.

Figure 3A:
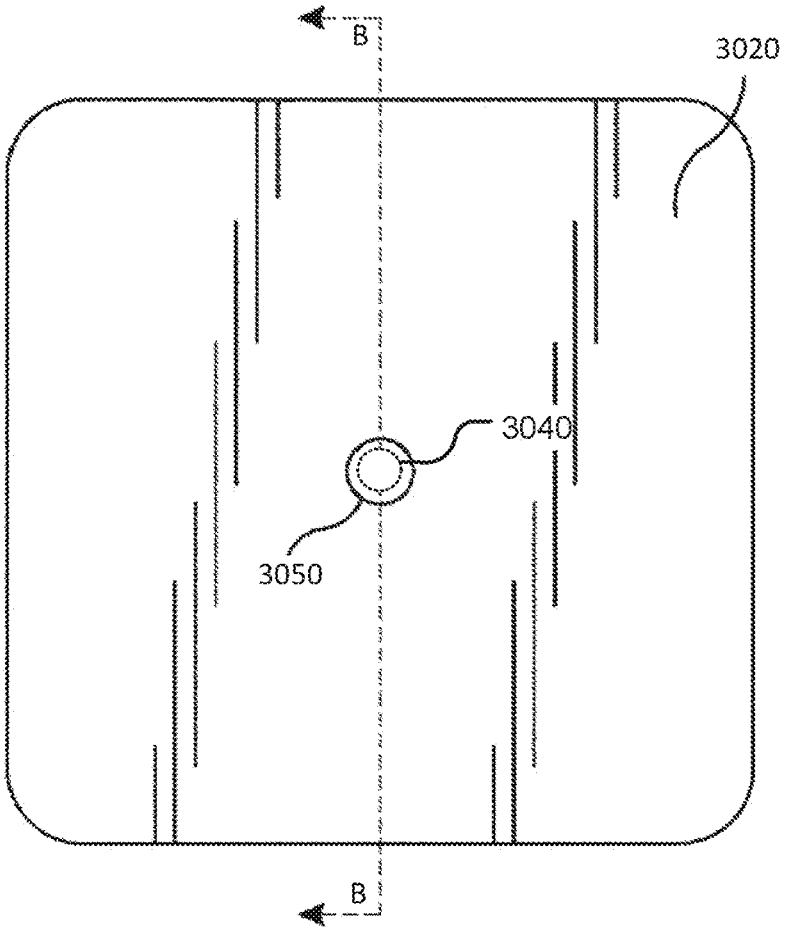
FIG. 3A—A rear view of certain embodiments of a panel
Figure 3B:
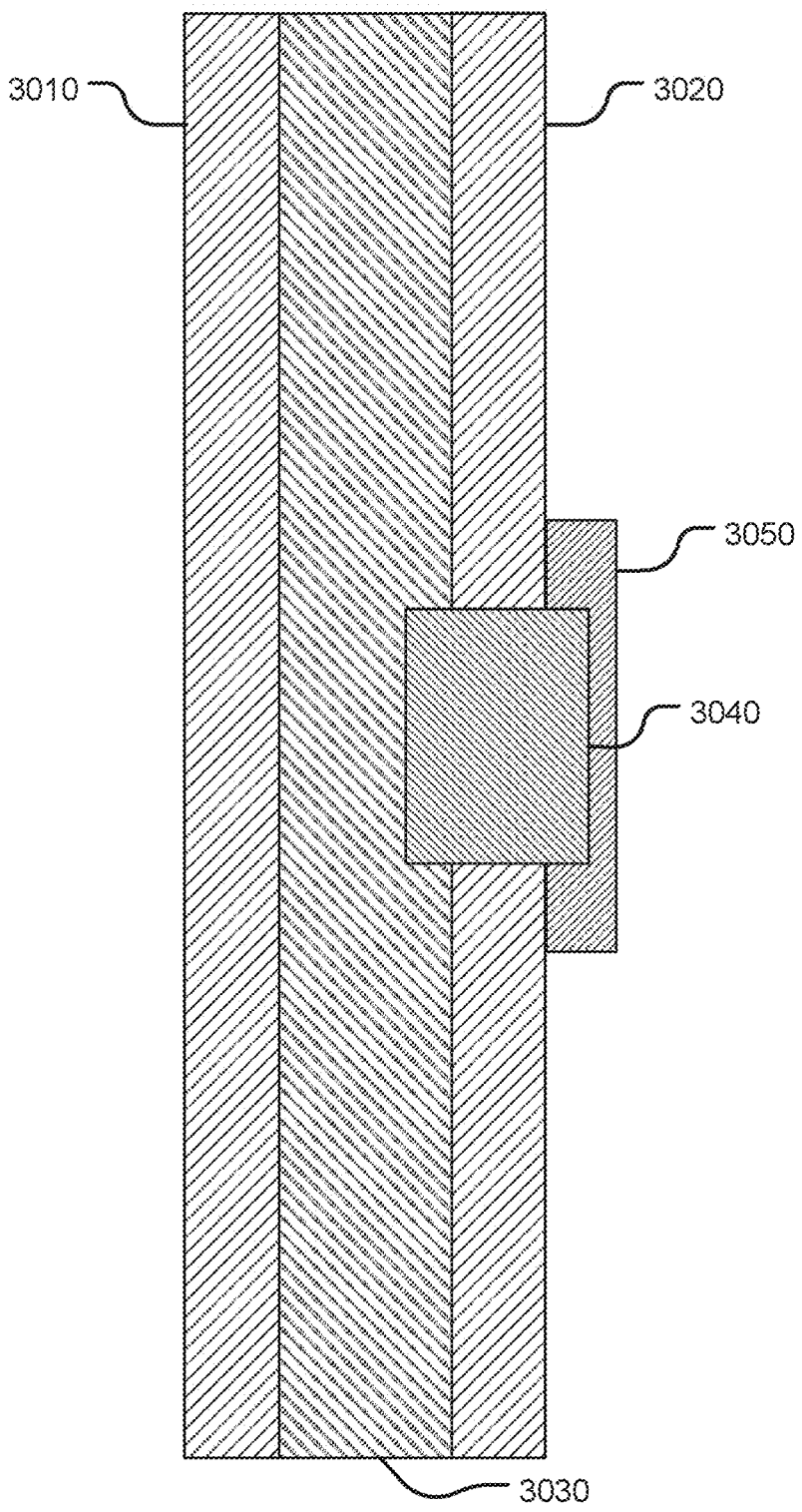

In some instances, the writing panel may include different attachment mechanisms, allowing the panel to be secured to different types of surfaces or objects in different manners. With reference to FIGS. 3A and 3B, the panel 3000 includes a spacer board 3030 located between a front surface 3010 and a rear surface 3020, forming a layered or stacked configuration. The panel also includes a first attachment member 3040 coupled to the rear surface 3020 and a second attachment member 3050 coupled to the rear surface 3020. One or both of the front surface 3010 and the rear surface 3020 may have, for example, a whiteboard or chalkboard treatment, or may otherwise be formed of a material that is conducive to reusable writing. The front surface 3010 and the rear surface 3020 may include other surface treatments providing an erasable writing surface. In some implementations, the front surface 3020 and the rear surface 3020 may be magnetically attractable surfaces. The spacer 3030 provides rigidity to the panel 3000 and may allow the panel to be constructed of a desired thickness of a lighter material than the materials forming the front and back layers. The spacer board 3030 may be any material that provides a spacer panel 3000 while being relatively light. For example and without limitation, the spacer board 3030 may be foam board, particle board, or cardboard. The spacer board 3030 may be one uniform material or may be layers of different materials. However, in other embodiments, the spacer board 3030 may be omitted.

The spacer board 3030 and/or the rear surface 3020 may define a recess or aperture therein that is shaped to receive the first attachment member 3040. In one example, the spacer board 3030 defines an attachment recess and the rear surface 3020 defines a corresponding attachment aperture aligned with the attachment recess. In this manner, the first attachment member 3040 may be seated within the attachment recess and may extend partially out of the attachment aperture, e.g., may partially protrude from rear surface 3020. In one example, the first attachment member 3040 extends beyond a plane of the rear surface.

The first attachment or connection member 3040 and the second attachment or connection member 3050 are configured to removably secure the panel to different objects or surfaces. To this end, the first attachment member 3040 and the second attachment member 3050 are configured to generate or otherwise define a connection or securing force operable to connect the panel to a corresponding surface. The two attachment members 3040, 3050 may be configured to generate different types of securing forces, allowing the panel to be attached to different objects or surfaces in different manners and/or allow enhanced securing of the panel to an object by interacting with both types of forces. In one example, the first attachment member 3040 is a magnet that exerts a magnetic attraction or securing force and the second attachment member 3050 is a suction foam that generates a suction force. However, in other examples, other types of connection forces may be included, such as, but not limited to, tacky materials, adhesive, hook and loop, fasteners, or the like, where the attachment allows the panel to be attached and detached multiple times, i.e., is not single use.

In one implementation, the first attachment member 3040 is a magnet covered or partially enclosed by the second attachment member 3050. For example, the second attachment member 3050 may be connected to or positioned over an exposed portion or surface of the first attachment member 3040 on the rear side of the panel. In this manner, the forces of the two attachment members can be aligned such that regardless of the type of surface or connection force being used, the panel can be oriented in the same direction. The second attachment member 3050 may be, for example micro-suction foam, or another material that exerts a connection force different from the first attachment ember. The configuration of a magnet 3040 located under micro-suction foam 3050 allows the panel 3000 to be mounted on magnetically attractable surfaces and on smooth surfaces suitable for receiving micro-suction foam. Further, the micro-suction foam 3050 is thin enough to allow the magnet 3040 to still securely attach the panel 3000 to magnetically attractable surfaces. In other implementations, the second attachment member 3050 may be, for example and without limitations, an adhesive surface or a hook structure designed to attach to a loop structure.

The first attachment member 3040 may be mounted partially within the panel 3000. The first attachment member 3040 may be adhered to the bottom of a recess in the rigid board 3030. The second attachment member 3050 may be adhered or otherwise attached to the first attachment member 3040 and may be adhered or otherwise attached to the rear surface 3020. When the first attachment member 3040 is a magnet, the magnet may be attached to the panel in a similar manner as discussed above with respect to the panel 1000. The first attachment member 3040 and the second attachment member 3050 may be located in the center of the rear surface 3020 to allow for alignment of multiple panels 3000. For example, multiple panels 3000 may be used in the configuration shown in and described with respect to FIGS. 2A and 2B.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding and variations thereof herein are meant to encompass the items listed thereafter and equivalents thereof, as well as, additional items.

The invention claimed is:

1. A reusable writing kit comprising:

a substrate comprising a substrate writable surface and a substrate rear surface; and a panel releasably and slideably mountable directly to the substrate, the panel comprising:

a panel writable surface;

a panel rear surface; and a first attachment member having a first type of securing force operable to mount the panel to the substrate, wherein when the panel is mounted to the substrate, the panel rear surface is spaced apart from the substrate writable surface and slidable thereal-ong.

2. The reusable writing kit of claim 1, wherein the substrate writable surface and the panel writable surface are wet or dry erasable surfaces.

3. The reusable writing kit of claim 1, wherein the substrate further comprises a substrate alignment member, wherein the substrate alignment member is configured to interact with the first attachment member to align the panel to the substrate.

4. The reusable writing kit of claim 3, wherein the panel further comprises a second attachment member having a second type of securing force operable to mount the first panel to the substrate, wherein the second type of securing force is different from the first type of securing force.

5. The reusable writing kit of claim 3, wherein the substrate alignment member is configured to exert an attraction force with the first attachment member to mount the panel to the substrate.

6. The reusable writing kit of claim 1, wherein the first attachment member is a magnet.

7. The reusable writing kit of claim 1, further comprising a plurality of panels.

8. A reusable writing system comprising:

a first panel comprising an erasable surface;

a second panel;

a first attachment member coupled to the first panel and positioned between the first panel and the second panel; and a second attachment member coupled to the second panel and positionable between the second panel and a substrate having an erasable surface, wherein the first panel is spaced apart from the second panel by at least a portion of a length of the first attachment member.

9. The reusable writing system of claim 8, wherein the first attachment further comprises a magnet.

10. The reusable writing system of claim 8, wherein the first attachment member extends from a rear surface of the first panel.

11. A reusable writing panel comprising:

a dry or wet erasable writing surface;

a back surface coupled to the dry or wet erasable writing surface; and an attachment member coupled to and extending outwards from the back surface so as to protrude from the back surface, wherein:

the attachment member is configured to define a gap between the back surface and a mounting surface when the reusable writing panel is positioned on the mounting surface, and the attachment member is further configured to slideably and releasably mount the reusable writing panel directly to the mounting surface.

12. The reusable writing panel of claim 11, wherein the attachment member comprises a suction foam.

13. The reusable writing panel of claim 11, wherein the attachment member comprises a first attachment member and the writing panel comprises a second attachment member.

14. The reusable writing panel of claim 13, wherein the second attachment member is configured to exert a second type of attachment force that is different from a first type of attachment force exerted by the first attachment member.

15. The reusable writing panel of claim 11, further comprising a spacer positioned between the dry or wet erasable writing surface and the back surface.

16. The reusable writing panel of claim 15, wherein the spacer is a foam board.

* * * * *